US005960664A

United States Patent [19]

Montero-Cantu et al.

[11] Patent Number: 5,960,664

[45] Date of Patent: Oct. 5, 1999

[54] CHANNEL FORMING AND PUNCHING MACHINE

[75] Inventors: Ramiro Montero-Cantu; Tiburcio Sosa-Razón, both of Monterrey, Mexico

[73] Assignee: Metalsa S. de R.L., Apodaca, Mexico

[21] Appl. No.: 09/063,964

[22] Filed: Apr. 21, 1998

[51] Int. Cl.[6] ..... B21D 5/04; B21D 28/32

[52] U.S. Cl. ..... 72/294; 72/312; 72/334

[58] Field of Search ..... 72/334, 333, 336, 72/327, 294, 315, 312

[56] References Cited

U.S. PATENT DOCUMENTS

| | | | |
|---|---|---|---|
| 440,051 | 11/1890 | Naylor | 72/312 |
| 4,489,584 | 12/1984 | Gall | 72/334 |
| 4,798,073 | 1/1989 | Dischler | 72/218 |
| 4,890,469 | 1/1990 | Dischler | 72/218 |

FOREIGN PATENT DOCUMENTS

| | | | |
|---|---|---|---|
| 176027 | 10/1983 | Japan | 72/334 |
| 137530 | 7/1985 | Japan | 72/315 |
| 841722 | 7/1981 | U.S.S.R. | 72/327 |
| 1031568 | 7/1983 | U.S.S.R. | 72/334 |

*Primary Examiner*—Daniel C. Crane
*Attorney, Agent, or Firm*—Abelman, Frayne & Schwab

[57] ABSTRACT

A simultaneously channel forming and punching machine, which forms a channel from a flat metal sheet and punches the side walls of the formed channel, comprising: a lower member, including a support frame and a die member mounted on the support frame having a sheet receiving surface and two side walls, each having perforations at a desired height; an upper member, mounted on a lowering and lifting mechanism, actuating on a lower member; a female member, retained by a support frame, having an upper wall and two depending side walls, each having perforations at a height coinciding with the perforations of the die member, and forming a channel housing receiving the die member when the upper member is lowered to form a channel; a retaining plate, resiliently retained into the channel forming housing of the female member for retaining a metal sheet to be bent; and punching elements coupled at the ends of the female member, for punching the side walls of a formed channel, passing through the perforations of the female member and the die member.

13 Claims, 4 Drawing Sheets

CHANNEL FORMING AND PUNCHING MACHINE

BACKGROUND OF THE INVENTION

A. FIELD OF THE INVENTION

The present invention relates to bending and punching machines, and more particularly to a channel forming and punching machine which simultaneously bends a metal plate as a "U" shaped channel and punch both side walls and the web thereof in a single machine and a single operation

B. DESCRIPTION OF THE RELATED ART

There is a number of well known bending machines for bending metal pieces such as wires, plates, etc., of the type wherein a metal piece is firstly bent by pressing such piece by means of a pressing member against a support member having a predetermined pattern.

With this type of machines a great variety of metal pieces can be manufactured, including channel shaped pieces of the type wherein a large metal plate is bent by its longitudinal edges usually at about 90°, which are used for multiple purposes such as in the automotive industry for the manufacturing of truck chassis or automotive chassis.

Usually, in the forming of a metal component, several stages are needed in the forming process. Each stage involves tools or specialized machines for performing some tasks (for example laminating, bending, piercing, etc.), therefore, when the forming process is long, the stages and the number of tools or machines is high and the production process of the final product usually takes a lot of time.

An efficient production process must have a minimum of stages in order to reduce the number of machines and consequently reduce the investment in equipment. With a less number of stages and machines, the production speed may be increased, a better client service is achieved since the product is delivered more quickly and savings in energy and manpower costs are obtained.

Also with less stages in the production process, the logistic system of the plant is optimized since the distribution of the equipment and production lines in the plant is compacted and therefore less inventory in process is obtained and a better flow of the product trough the production system is achieved.

The most common stages in the forming of metal pieces are the piercing and bending steps, which actually are carried out in separate machines. Therefore it is highly desirable to carry out the steps of piercing and bending in a single operation and in one machine in order to simplify the step of only piercing and only bending.

For some specific uses, the side walls of the channel need to be punched. The punching step was very difficult to carry out when the channel was already formed and usually at least one punching machine was necessary for punching firstly one side wall, and then the other. One alternative to avoid the above step is to punch a flat large metal sheet before the channel is formed, but there is the need of calculating the exact location of the perforations in the metal sheet in order to guarantee that the perforations reach the correct position when the channel is formed, which is very difficult to achieve and it is not reliable.

One bending machine for forming "U" pieces such as rounded bars, channels, sections and the like, is disclosed in U.S. Pat. Nos. 4,798,073 and 4,890,469 both of Dischler, which comprises two opposed spaced bending devices, each including at least two bending components and drive means to move at least one of the bending components essentially transversely to the length of the piece to be bend.

To produce a rounded "U" shaped piece, the piece to be bent is placed between the bending components of each of the bending devices and then, a bending moment is applied by the bending components of two of the bending devices, acting transversely to the longitudinal axis of the piece. Due to the application of such bending torque the piece is bent in a rounded "U" shape.

Such machine, cannot produce pieces with side walls at about 90° and it is not possible to punch the sides of the rounded "U" shaped piece or a channel in the same machine.

In the actually known art, although highly desirable, there is no machine available which be capable of simultaneously bend a metal plate as a "U" shaped channel, and punch one or both side walls thereof in a single machine and in a single operation, mainly because there was no possibility to punch the side walls and/or the web of the channel when it is being formed in the same stroke.

Considering the above referred problems, applicants developed a channel forming and punching machine, which simultaneously forms a channel from a metal sheet and punches the side walls of a formed channel, comprising: a lower member including: a support frame; a die member mounted on the support frame, said die member having a sheet receiving surface and two side walls each having perforations at a desired height; and an upper member, mounted on a lowering and lifting mechanism, actuating on the lower member, and including: a support frame; a female member retained by the support frame, said female member having an upper wall and two depending side walls each having perforations at a height coinciding with the perforations of the die member, said upper wall and said side walls forming a channel shaped housing which receives the die member when the upper member is lowered to form a channel; a blank holder, resiliently retained into the channel shaped housing of the female member, for retaining a metal sheet to be bent; and punching elements coupled at the ends of the female member, for punching the side walls of a formed channel, passing through the perforations of the female member and the die member.

Since the forming and punching process are carried out in one machine, there is no need to invest in separate punching and bending machines (which generally are large), besides saving plant space and energy costs.

SUMMARY OF THE INVENTION

It is therefore a main objective of the present invention to provide a channel forming and punching machine which simultaneously bends a metal plate as a "U" shaped channel, and punch one or both side walls thereof, and if desired the web, in a single machine and a single operation It is another objective of the present invention to provide a channel forming and punching machine of the above disclosed nature, which eliminates the stages of only piercing or only bending.

It is still another objective of the present invention to provide a channel forming and punching machine of the above disclosed nature, which eliminates the need of investing in separate piercing machines and bending machines, It is a further objective of the present invention to provide a channel forming and punching machine of the above disclosed nature, which substantially reduces the energy used for separate machines since it provides the two functions, i.e. bending and punching, in a single one, saving plant space and energy costs.

These and other objectives and advantages of the channel forming and punching machine of the present invention will become apparent to those persons having an ordinary skill in the art, from the following detailed description of the invention which will be made with reference to the accompanying drawings.

BRIEF DESCRIPTION OF THE DRAWINGS

The invention is illustrated with reference to the enclosed drawings, in which.

DETAILED DESCRIPTION OF THE INVENTION

Figure 1:
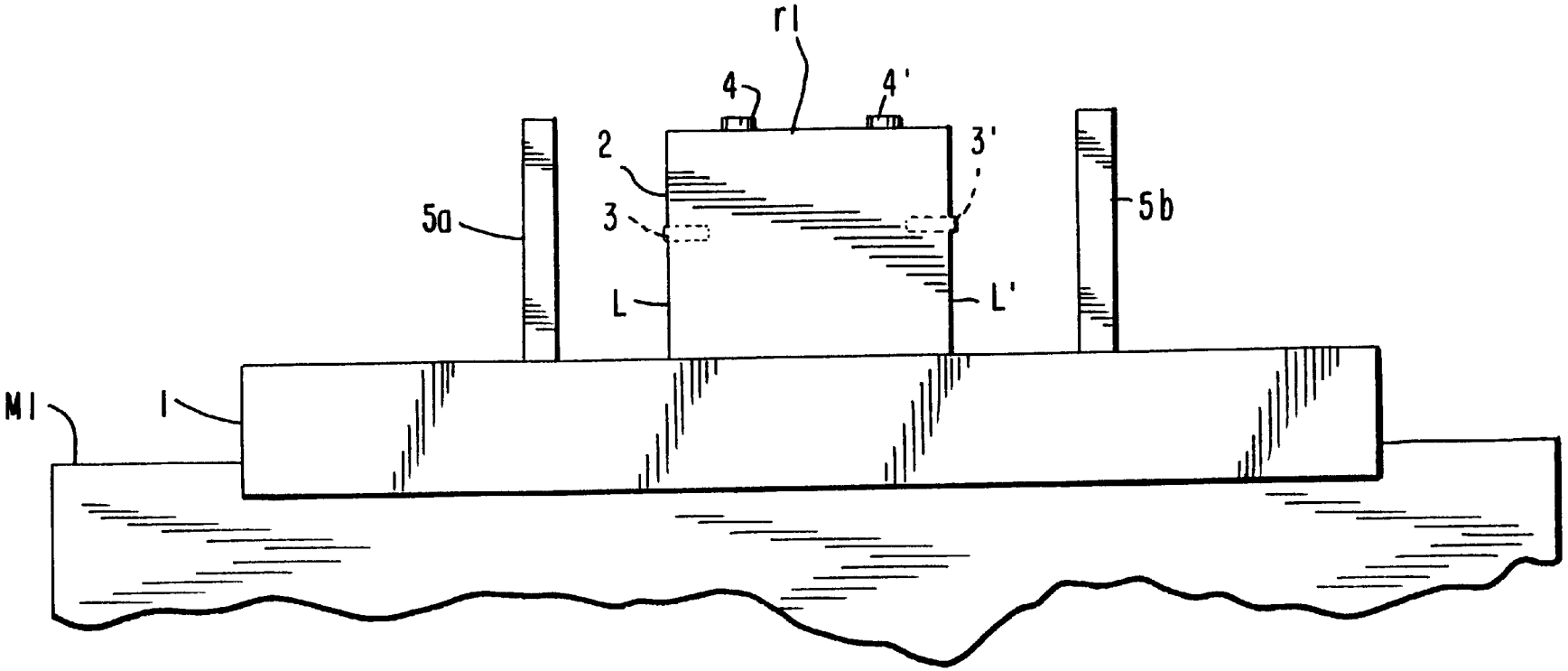
FIG. 1 is a front view of the lower member of the channel forming and punching machine in accordance with the present invention.
Figure 2:
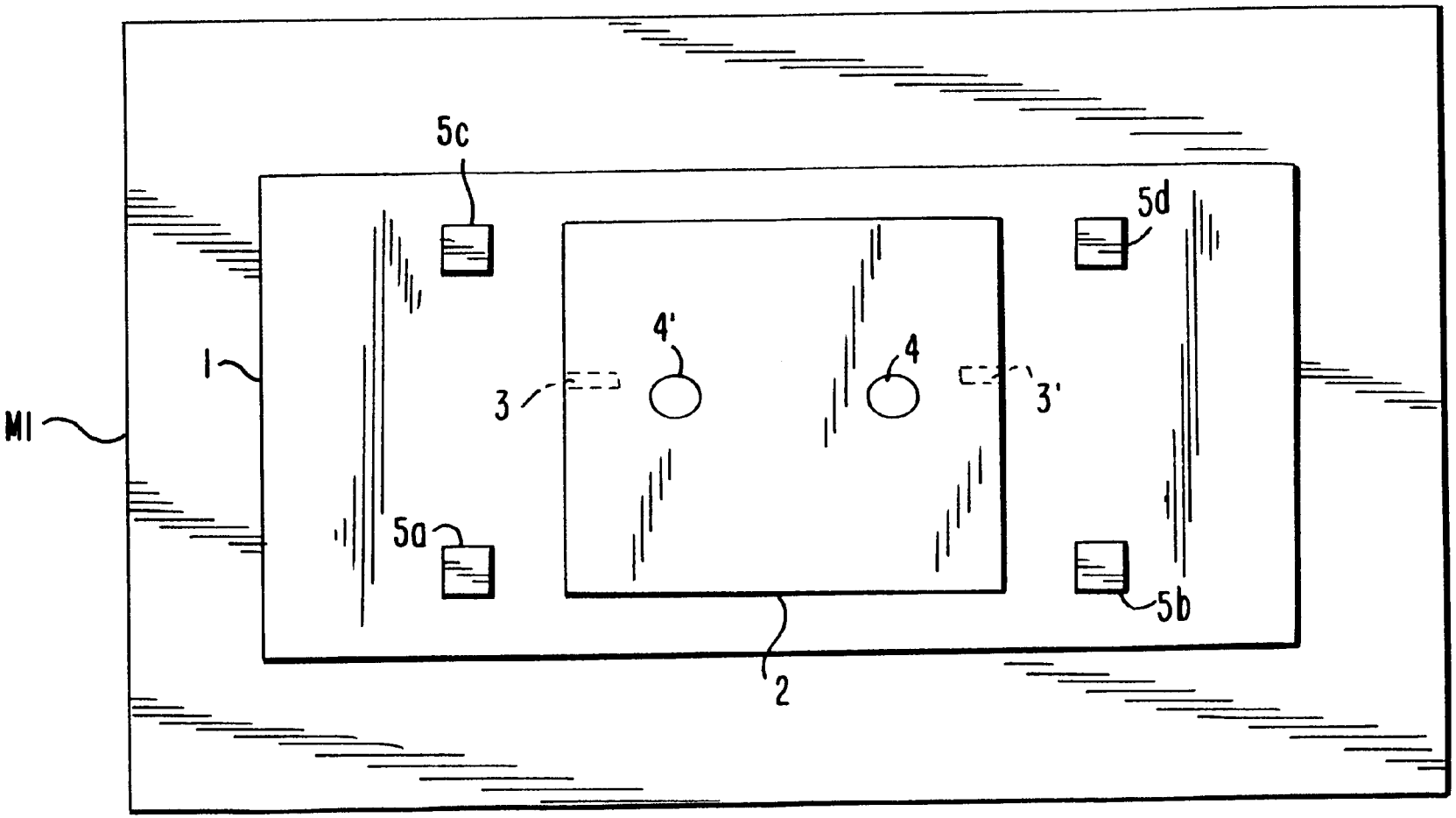
FIG. 2 is a schematic plant view of the lower member of the channel forming and punching machine in accordance with the present invention.
Figure 3:
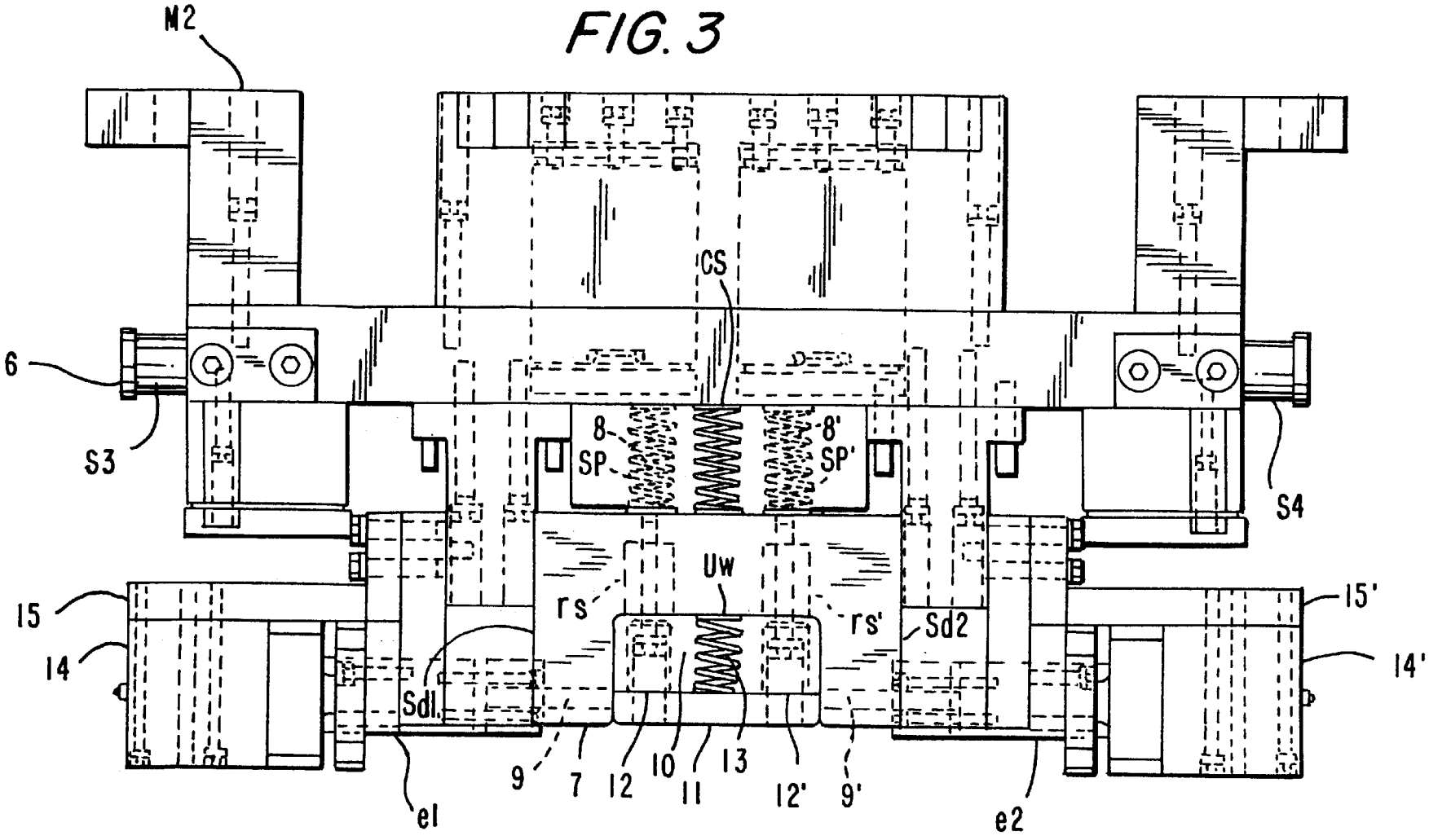
FIG. 3 is a front view of the upper member of the channel forming and punching machine in accordance with the present invention.
Figure 4:
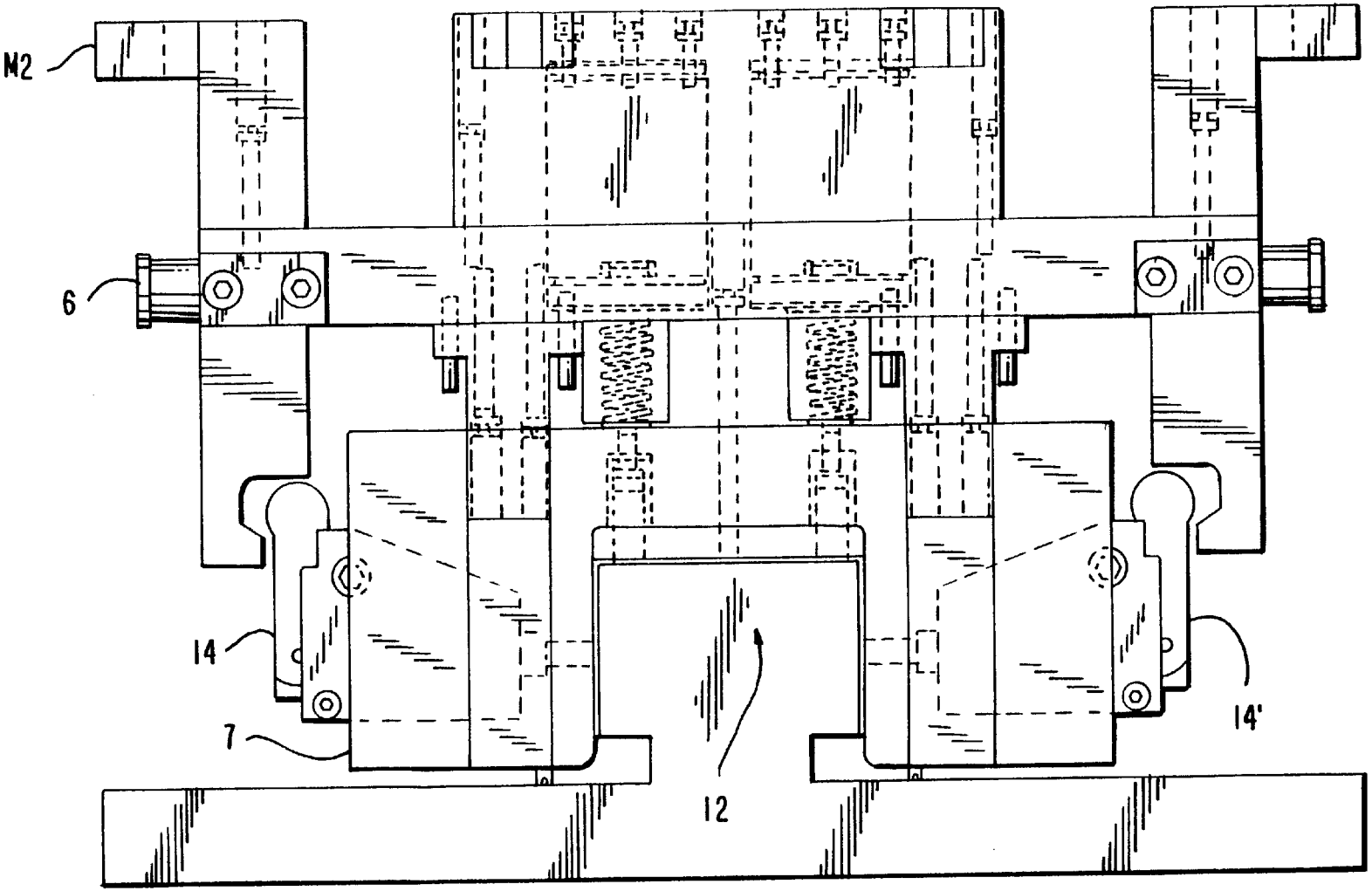
FIG. 4 is a front view of a second embodiment of the channel forming and punching machine in accordance with the present invention.

Referring to FIG. 1, FIG. 2, and FIG. 3, the channel forming and punching machine, of the present invention, will be now firstly described in accordance with a preferred embodiment thereof, comprising:

A lower member M1, including:

a support frame 1;

a die member 2 mounted at the middle portion of the support frame 1, having a metal sheet receiving surface r1 in which the metal sheet to be bent is placed, and two side walls L, L', each having a plurality of holes 3,3' properly placed at a desired height thereof, and two or more strippers 4,4' resiliently mounted in the metal sheet receiving surface r1 in order to bounce the channel from the die member 2 after the bending is finished and to easily remove the formed channel from the metal sheet receiving surface;

four support members 5*a*, 5*b*, 5*c*, 5*d*, each resiliently mounted on the support frame 1, having a height corresponding to the height of the strippers 4,4', in order to constitute support points around the die member, for supporting the metal sheet before it is bent;

an upper member M2, mounted on a lowering and lifting mechanism (not illustrated), actuating on the lower member M1, and including:

an upper support frame 6, having a first end s3 and a second end s4;

a female member 7, resiliently retained at the middle portion of the support frame by means of at least two lateral guide members 8,8' surrounded by springs SP, SP' and a central spring CS, this female member 7 having:

an upper wall uw and two depending side walls sd1, sd2, each depending from an end of the upper wall uw and including a plurality of holes 9,9' at a height corresponding to the height of the die member 2, forming a channel shaped housing 10 at a central portion of the female member 7, in which the die member 2 penetrates when the upper member M1 is lowered in order to form a channel from a metal sheet and compressing the support members 5*a*, 5*b*, 5*c*, 5*d* resiliently mounted on the support frame 1 of the lower member M1; and a blank holder 11, resiliently retained into the housing 10 of the female member 7, by means of lateral guide members 12, 12' received in recesses rs1, rs2, at the upper wall uw of the female member 7 and a spring 13 for pressing the blank holder 11 against the metal sheet receiving surface r1 of the die member 2, when the upper member M2 is lowered, in order to avoid any movement of the metal sheet placed on the metal sheet receiving surface, and then compressing the spring 13 and the springs sp,sp' when the female member 7 is additionally lowered for bending the plate and finally punched;

hydraulic cylinder and piston assemblies 14, 14' each mounted on a respective support 15, 15' retained at the side walls sd1,sd2 of the female member 7, at a height corresponding to the holes 9,9' thereof punching members (not illustrated), each coupled to the hydraulic cylinder and piston assemblies 14,14' in order to punch the side walls of a formed channel, penetrating through the perforation of the side walls sd1 and sd2 of the female member 7 and the perforations of the side walls L,L' of the die member 2;

a mechanic sensor (not illustrated) comprising a hydraulic cylinder and piston assembly, retained at an end of the support frame 6 which is compressed when the upper member M2 is lowered reaching to the die member 2 into coincidence with the housing 10 of the female member 7, once the metal sheet is bent, sending oil under pressure to the hydraulic cylinder and piston assemblies 14,14' in order to drive the punching members to punch the side walls of the channel.

The support frame of the upper member may also include punching members (not illustrated) in order to punch the web of a channel, when desired.

In another embodiment of the present invention, the female member 7 is fixedly retained at the middle portion of the support frame 6, and an electronic sensor (not illustrated) is retained at the support frame 6 which detects when the upper member M2 is lowered and reaching to the die member 2 into coincidence with the housing 10 of the female member 7 and provide a signal representative of an end run of the female member once the metal sheet is bent, to a controller (not shown), such as a data processor, which actuate the hydraulic cylinder and piston assemblies 14,14' in order to punch the side walls of the formed channel to control means (not illustrated) which activate the hydraulic cylinder and piston assemblies or electric motors 14,14' that pushes the piercing elements which carry out the perforation of the side walls of the formed channel.

Finally it must be understood that the channel forming and punching machine, of the present invention, is not limited exclusively to the embodiments above described and illustrated and that the persons having ordinary skill in the art can, with the teaching provided by the invention, to make modifications to the design and component distribution of the bending machine of the present invention, which will clearly be within of the true inventive concept and of the scope of the invention which is claimed in the following claims:

We claim:

1. A channel forming and punching machine, which simultaneously forms a channel from a flat metal sheet and punches the side walls of the formed channel in one step and in the same machine, comprising:

a lower member, including:

a support frame; and a die member mounted on the support frame having an upper metal sheet receiving surface and side walls, each having perforations at a desired position;

an upper member, mounted on lowering and lifting means, actuating on the lower member, including:

a support frame;

a female member, retained by the support frame, having an upper wall and two depending side walls, each having perforations at a height coinciding with the perforations of the die member, and forming a channel housing receiving the die member when the upper member is lowered in order to form a channel from a metal sheet;

retaining means, resiliently retained into the channel forming housing of the female member for retaining a metal sheet to be bent; and punching means coupled at the ends of the female member, for punching the side walls of a formed channel, passing through the perforations of the female member and the die member, said punching means being adapted to be actuated by the lowering of the upper member.

2. The machine as claimed in claim 1, wherein the upper metal sheet receiving surface of the die member includes stripping means mounted thereon, allowing to remove a formed and punched channel.

3. The machine as claimed in claim 1, wherein the support frame of the lower member, includes support means resiliently mounted on the support frame, for receiving and supporting a metal sheet to be bent, which are compressed when the female member is lowered to the die member.

4. The machine as claimed in claim 2 wherein the stripping means, include resilient blanks mounted on springs, to be compressed when the retaining means are lowered into contact with the metal sheet to be bent and punched, and bounce a formed and punched channel form the upper metal sheet receiving surface when the upper member is lifted, allowing the channel to be removed from the machine.

5. The machine as claimed in claim 1, wherein the retaining means for retaining a metal sheet to be bent, is a blank holder retained into the housing of the female member, by guide members penetrating into recesses at the upper wall of the female member, and a spring to allow the plate to be compressed into the housing of a female member.

6. The machine as claimed in claim 1, wherein the female member is resiliently retained by guide members surrounded by springs which are compressed when the female member is additionally lowered for bending the plate.

7. The machine as claimed in claim 1, wherein the punching means includes drive means associated therewith.

8. The machine as claimed in claim 7, wherein the drive means are pneumatic cylinder and piston assemblies.

9. The machine as claimed in claim 7, wherein the drive means are hydraulic cylinder and piston.

10. The channel forming and punching machine as claimed in claim 7 wherein the drive means are electric motors.

11. The machine as claimed in claim 7 including control means having sensor means providing a signal representative of a final bending run of the upper member in order to activate the drive means associated with the punching means.

12. The machine as claimed in claim 11, wherein the female member is fixedly retained at the support frame, and the control means include an electronic sensor retained at the upper frame, providing a signal representative of the final bending run of the upper member in order to activate the drive means associated with the punching means.

13. The machine as claimed in claim 1, wherein the support frame of the upper member includes punching means in order to punch the web of a channel.

* * * * *